United States Patent [19]

Vasek

[11] 4,222,446

[45] Sep. 16, 1980

[54] CUTTER WITH CUTTER HOLDER FOR DISINTEGRATING OF MATERIAL, PARTICULARLY OF ROCK

[75] Inventor: Jaroslav Vásek, Frydek-Mistek, Czechoslovakia

[73] Assignee: Vedecko vyzkumny uhelny ustav, Ostrava Radvanice, Czechoslovakia

[21] Appl. No.: 964,360

[22] Filed: Nov. 28, 1978

[30] Foreign Application Priority Data

Nov. 29, 1977 [CS] Czechoslovakia ..... 7874-77

[51] Int. Cl.[2] ..... E21B 9/00

[52] U.S. Cl. ..... 175/329; 175/413; 407/54

[58] Field of Search ..... 175/327, 329, 379, 409, 175/413; 407/34, 54; 279/1 J, 86, 97

[56] References Cited

U.S. PATENT DOCUMENTS

| | | | |
|---|---|---|---|
| 336,566 | 2/1886 | Happersberger | 407/54 |
| 1,676,887 | 7/1928 | Chamberlin | 175/409 X |
| 2,833,520 | 5/1958 | Owen | 175/379 |
| 3,548,476 | 12/1970 | Laue et al. | 407/54 |
| 3,692,127 | 9/1972 | Hampe et al. | 175/330 |
| 3,863,316 | 2/1975 | Yeo | 407/54 |

*Primary Examiner*—James A. Leppink

[57] ABSTRACT

A cutter element having a peripheral working surface and a frontal face, defining therebetween a cutting edge. The working surface of a cutter element is formed in the shape of a solid of rotation generated about a longitudinal axis. The axial section of the working surface forms with a plane passing through its cutting edge and perpendicular to the longitudinal axis, an angle selectable within 40° to 120°. The cutter element is provided with a shaft, which is supported for rotation around the longitudinal axis in a holder adapted to be mounted on a heading or combine tool.

8 Claims, 7 Drawing Figures

4
2
1
3

5

6
2

5

6

CUTTER WITH CUTTER HOLDER FOR DISINTEGRATING OF MATERIAL, PARTICULARLY OF ROCK

BACKGROUND OF THE INVENTION

The present invention relates to a cutter element and a cutter holder assembly forming a bit for the disintegration or cutting of mined material of all kind, particularly of rocks.

Mining tools for disintegrating rock and similar mineral substances are provided with a header or combine on which a plurality of cutter tools are mounted, to revolve about the common axis of the carrier. While the known cutting tools or machine tools, of such heading and mining combines have different shapes and sizes, they are however similar and imperfect in that their cutting edges are short, the cutting edges of the cutting tools are in contact with the material along their entire length, and they have a relatively high cutting speed with respect to the disintegrated material. The cutting edges of the cutting tools are exposed to concentrated, intensive and simultaneously acting power, temperature and abrasive effects. These effects are intense particularly when disintegrating materials which are inherently difficult to disintegrate and which are abrasive for instance rocks with a high content of abrasive minerals such as $SiO_2$ and the like. Thus, the cutting edges of the cutters are quickly worn, their original progressive geometry becomes changed and the efficiency and accuracy of cutting tools is reduced. This leads to an increase of resistance to the disintegrated material, to a worsening of heat conditions and to a reduction of the output. The high cutting speed together with increasing power and temperature effects can cause overheating of the tool, and its destruction and even the generation of a hot spark. When cutting materials are surrounded by dangerous gases or explosive dust, the overheating of tools can also cause an explosion.

SUMMARY OF THE INVENTION

It is an object of this invention to eliminate to a high degree these drawbacks and to provide a cutter, the cutting edge of which is of greater length, whereby only part of which would be in engagement with the material to be cut, and which is able to rotate during use and thus utilize its entire circumferential cutting edge so as to operate cooler.

The cutter and cutter holder assembly according to the present invention comprises a cutter element having the shape of a solid figure of rotation provided with a shaft adapted to be secured in a tool holder for rotation about its longitudinal axis but fixed against axial shifting. The cutting edge is formed by the frontal edge of the peripheral surface of the solid figure of rotation and of its outer base. The working surface of the cutter is the peripheral surface of the solid figure of rotation, the axial section of which forms an angle with a plane passing through the cutting edge, selected between 40° and 120°. The cutting element is firmly connected to the cutter shaft, which is supported in the tool holder for rotation around its longitudinal axis. The plane passing through the cutting edge is perpendicular to the longitudinal axis. The surface of the cutter element with the cutting edge can be made wholly of hardened cutting material. It can comprise an annular circumferential part of hardened cutting material or it can comprise sections in the shape of segments of hardened cutting material extending toward the circumference. The hardened cutting material can be sintered carbide or industrial diamonds.

Advantages of the cutter element according to this invention are that its cutting edge is long, and only part of it is in engagement with the material to be cut, the cutting element is able to turn and thus utilize its entire circumferential surface for cutting, enabling effective cooling.

These advantages provide as a consequence an increase in the life of the cutters and thus a saving of material and cost of manufacture, an increase of the output and accuracy of cutting, an increase of the uniformity of operation of machines provided with these cutters and thus a prolongation of their life time. There are also savings of time due to replacements of worn cutters or due to their adjustment. The range of application of cutters is extended also for disintegration of materials more difficult to disintegrate.

The use of the cutter according to this invention results in an improvement of the safety of working when cutting materials, or when disintegrating rocks with a higher content of abrasive materials, which normally generate sparks. The cutter results in a significant reduction of such sparks and thus is beneficial in dangerous surroundings to avoid ignition or explosion of gases or dust.

DESCRIPTION OF THE DRAWINGS

The attached drawings illustrate diagrammatically exemplary embodiments of cutters of the present invention.

DESCRIPTION OF THE PREFERRED EMBODIMENTS

Figure 1:
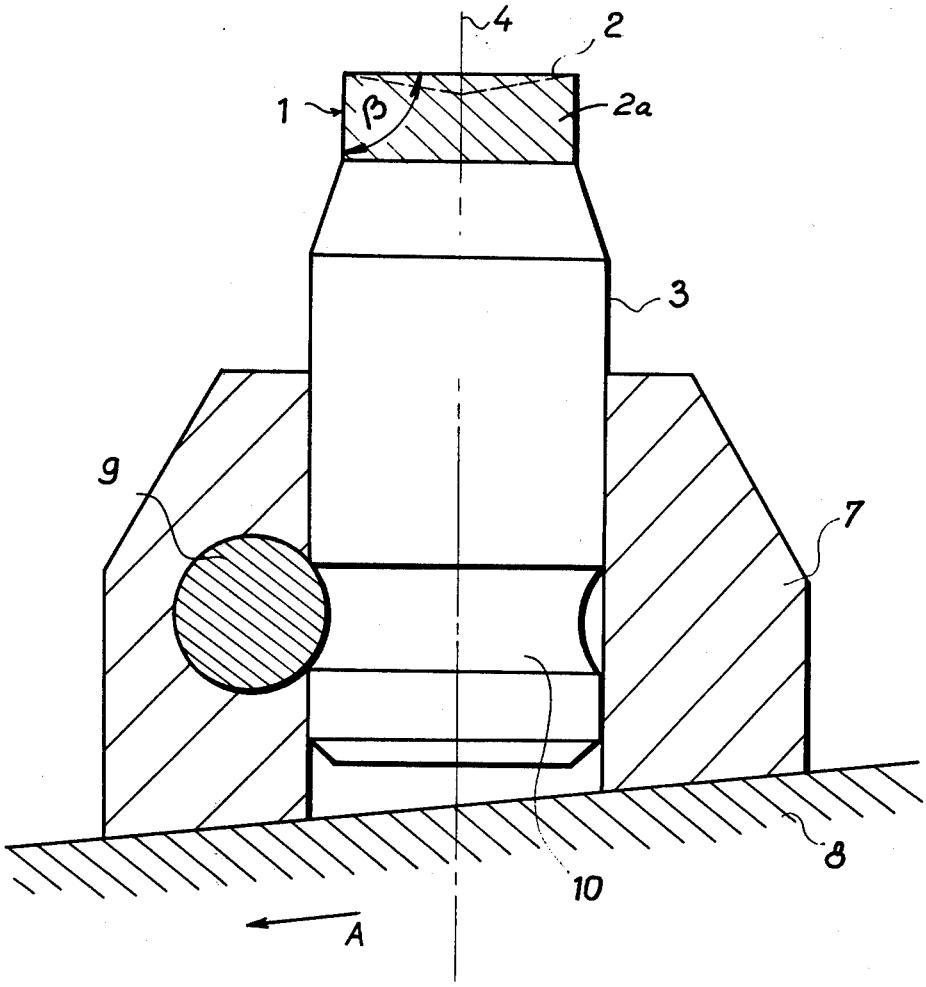
FIG. 1 is a partly longitudinal sectional view of the cutter assembly showing the fundamental shape of a cutter element and holder.

FIG. 1 shows an exemplary embodiment of a cutter head 1 located at the end of a supporting shaft 3. According to this invention the cutter head comprises a frontal base and a peripheral surface 2*a*, between which is defined a working edge 2. The working surface 2*a* is in the shape of any solid rotationally generated about a central longitudinal axis 4 and forms with a plane passing through the cutting edge 2, which plane is perpendicular to the central longitudinal axis 4, an angle $\beta$, which is between 40° to 120°, and in the illustrated FIG. 1, 90°. The supporting shaft 3 of the cutter is a cylindrical body having an annular groove 10 for securement notably in a cutter holder 7. The shaft is held by a pin 9, secured in the holder 7, which tangentially extends into the groove. In this manner axial shifting of the cutter is prevented while the cutter is slidably rotatable in the cutter holder 7 about the central longitudinal axis 4. The cutter holder 7 is fixed to the surface of an arcuate body 8 forming the plural knife carrier of the operating element of a heating or mining combine which is rotated about its own axis in the direction of the arrow A. The cutter head 1 is firmly connected to the cutter shaft 3. The space of the cutter below the plane passing through the cutting edge 2 can be releaved by a recess as shown by the dotted lines.

Figures 2, 3, 4, 5, 6, 7:
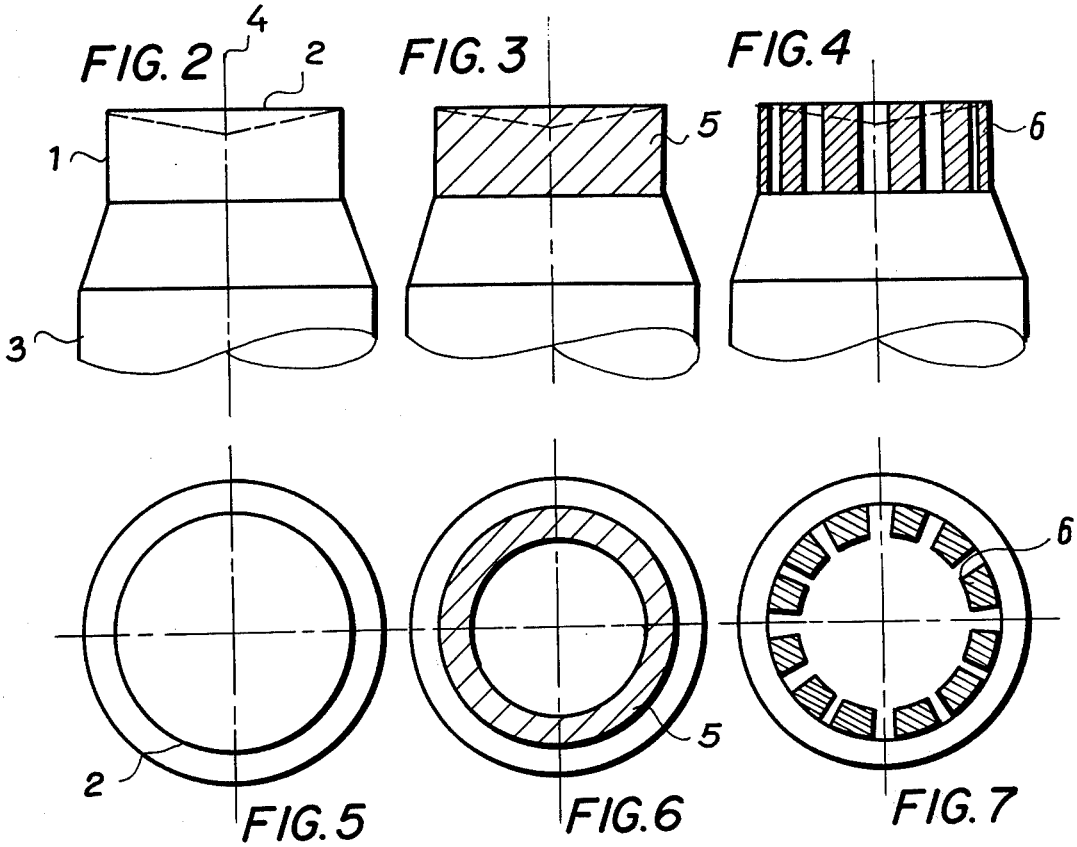
FIGS. 2, 3 and 4 are elevational views of different alternative forms of the cutter element.
FIGS. 5, 6 and 7 are plan views of the cutter element shown in FIGS. 2, 3 and 4, respectively.

FIG. 2 shows an example of a cutter 1 which is formed as a solid cylinder, wholly of hardened cutting material.

In FIG. 3 another example of a cutter 1 is shown which is formed of an annular ring 5 of hardened cutting material.

In FIG. 4 still another example of a cutter is shown which comprises segment shaped parts 5 of hardened cutting material, extending in direction toward the circumference.

According to this invention the cutter element, including the working surface *2a*, the base and the cutting edge may be of sintered carbine or other materials and may be provided with regularly or irregularly situated geometrical formations such as, for instance industrial diamonds and similar abrasive material.

The more easily the material to be cut or worked on can be disintegrated and the less abrasive that it is, the smaller can be the angle $\beta$, and the smaller requirements on the quality of the working surface and cutting edge are made. For cutting of materials easy to disintegrate, i.e. metals such as copper, aluminium, dural, or rocks such as claystone, the angle $\beta$ can be between 40° to 70°. For cutting of materials more difficult to disintegrate or more abrasive, i.e. metals such as gray cast iron, cast steel, or rocks such as sandy siltstone, the angle $\beta$ can be greater, i.e. between 90°–120°. In the latter cases the cutter may also be made of special materials or provided with hardened cutting material or with industrial diamonds.

The cutter for disintegrating of material, particularly of rocks can be used for cutting and working of all materials, not only of rocks.

I claim:

1. A mining cutter bit and holder assembly comprising a cutter element for use in a mining tool for disintegrating rock and the like having a carrier on which a plurality of said assemblies are mounted to revolve about a common axis, comprising a cutter element secured at the end of a supporting shaft having a central longitudinal axis, said cutter element having a shape of a solid figure of rotation and being provided with a peripheral working surface and a frontal base, defining between them a cutting edge, the axial section of the peripheral surface forming with a plane passing through the cutting edge and perpendicular to the longitudinal axis an angle between 40°–120° and a holder mountable on the tool carrier, said holder having a recess the axis of which extends outwardly at an angle to the common axis of rotation, for receiving the shaft of the cutter element and means for retaining said shaft in said recess to permit rotation of said cutter element relative to said holder about the longitudinal axis of said shaft while preventing axial movement of said shaft therein.

2. The assembly according to claim 1, wherein said means for retaining said shaft in said holder comprises an annular groove formed in the surface of said shaft and a pin located in said holder and tangentially engaging within said shaft.

3. The assembly according to claim 1, wherein the cutter element is a solid block.

4. The assembly according to claim 1, wherein the cutter element is an annulus.

5. The assembly according to claim 1, wherein the cutter element comprises a plurality of arcuately, shaped segments.

6. The assembly according to claim 3, 4 or 5, wherein the cutter element is formed entirely of hardened cutting material.

7. The assembly according to claim 6, wherein said hardened cutting material is sintered carbide.

8. The assembly according to claim 3, 4 or 5, wherein said cutter element is provided with industrial diamonds as cutting material.

* * * * *